US005879216A

United States Patent [19]

Yoshii et al.

[11] Patent Number: 5,879,216

[45] Date of Patent: Mar. 9, 1999

[54] METHOD OF FIXING MERCURY CONTAINING ALLOY WITHIN FLUORESCENT TUBES

[75] Inventors: Yasuto Yoshii, Settsu; Ikuhiro Okuno, Kyoto; Shozo Miyamoto, Omihachiman; Masayuki Tanaka, Takatsuki; Masahiro Yoshimoto, Takatsuki; Masao Kubo, Takatsuki; Tooru Watanabe, Nishinomiya; Tsuyosi Yokogawa, Ako, all of Japan

[73] Assignee: Matsushita Electronics Corporation, Osaka, Japan

[21] Appl. No.: 812,403

[22] Filed: Mar. 5, 1997

[30] Foreign Application Priority Data

Mar. 8, 1996 [JP] Japan ..... 8-051274
Jul. 22, 1996 [JP] Japan ..... 8-191926

[51] Int. Cl.[6] ..... H01J 9/395

[52] U.S. Cl. ..... 445/9

[58] Field of Search ..... 445/9, 14, 17

[56] References Cited

FOREIGN PATENT DOCUMENTS 6260139 9/1994 Japan .
6338286 12/1994 Japan .

*Primary Examiner*—Kenneth J. Ramsey
*Attorney, Agent, or Firm*—Stevens, Davis, Miller & Mosher, L.L.P.

[57] ABSTRACT

By applying radiation beam energy to a contact portion between an end portion 7 of a glass tube 1 and a zinc-mercury alloy drop 6 and the vicinity thereof by means of an optical fiber 5, the alloy drop 6 is directly heated so as to be caused to partly melt at a bottom portion thereof and fixed firmly to an inner wall surface of the end portion 7 of the glass tube without causing variations.

13 Claims, 4 Drawing Sheets

METHOD OF FIXING MERCURY CONTAINING ALLOY WITHIN FLUORESCENT TUBES

FIELD OF THE INVENTION AND RELATED ART STATEMENT

This invention relates to a fluorescent lamp or bulb and a method for manufacturing the same.

Followed by the recent growth of interest in global environmental problems, environmental pollution, contamination of manufacturing site or the like attributed to mercury spill from waste fluorescent bulbs are becoming serious problems. It is therefore becoming a subject to reduce the amount of mercury to be sealed in the fluorescent bulb.

There have conventionally been known two methods for sealing mercury in a glass tube. According to a first method, liquid mercury is dropped into a fluorescent bulb through an exhaust tube by means of a dropper, while according to a second method, a mercury-sealed capsule (glass capsule or metal capsule) in which liquid mercury is sealed beforehand is mounted inside a fluorescent bulb in the vicinity of one of electrodes and, after closing or chipping off an exhaust tube, the mercury-sealed capsule is opened to release mercury within the fluorescent bulb.

However, the first method has a problem that since the liquid mercury might stagnate in a dropper passage, the exhaust tube or the like, the amount of sealed mercury differs from bulb to bulb, and therefore the average amount of sealed mercury must be increased in order to ensure the required lifetime.

On the other hand, the second method has a following problem. Namely, in case that the mercury-sealed capsule is beforehand mounted inside the straight fluorescent bulb in the vicinity of one of the electrodes, when shaping a bent tube portion on the straight fluorescent bulb, e.g., shaping the fluorescent bulb into a circular one, an interior of the fluorescent bulb becomes a high temperature atmosphere to cause the mercury-sealed capsule to be broken due to this high heat to thereby release mercury. Thereafter, the mercury is exhausted in the succeeding evacuating step.

Recently, to solve the above problems, there has been proposed a third method in which a zinc-mercury alloy drop melts to be fixed to that portion of the inside of a fluorescent bulb which is not coated with fluorescent material (Japanese Patent Unexamined Publication No. 6-338286).

According to the above third method, the zinc-mercury alloy drop is thrown in the fluorescent bulb. After chipping off an exhaust tube, the alloy drop is moved to that portion of an inner wall surface of a glass tube which is not coated with fluorescent material. The alloy drop is heated to melt so as to be fixed to the inner wall surface of the glass tube. However, when fixing in this way, the temperature at which an adhesion surface is formed must be not higher than a boiling point of mercury and not lower than a temperature at which mercury in liquid phase mainly fills up a gap between the inner wall surface of the glass tube and the alloy drop. For this reason, the heating temperature should be restricted within a narrow range. This makes it hard to control the temperature. Additionally, it is found that, according to the third method, the alloy drop may fail to adhere to the inner wall surface of the glass tube.

As a result of investigation of the cause of this failure, it is found that when the alloy drop cannot be placed well, it is impossible to supply a sufficient quantity of heat required to melt the alloy drop. Further, since the heat for melting the alloy drop is supplied by hot blast from the outside of the glass tube, transfer of heat mostly depends on the heat conduction of the glass tube, and therefore heat cannot be transferred well if the inner wall surface of the glass tube is uneven, resulting in variations in melting condition of the alloy drop.

Moreover, in the fluorescent bulb in which the alloy drop has failed to adhere to the inner wall surface of the glass tube or has been separated therefrom due to vibration and the like, the alloy drop is allowed to freely move within the glass tube, giving rise to the problems that the movement of the alloy drop causes the coating of fluorescent material to be damaged, that the alloy drop casts a black shadow to be mistaken for a foreign matter when it is moved onto the coating of fluorescent material, and that since the alloy drop makes a noise when the bulb is shaken, users and the like will mistake the bulb for a defective one.

OBJECT AND SUMMARY OF THE INVENTION

The present invention aims to solve the above problems. An object of the present invention is to provide a fluorescent bulb in which an alloy drop can be firmly fixed to an inner wall surface of a glass tube, and a method for manufacturing a fluorescent bulb which is capable of reducing an average amount of sealed mercury by minimizing variations in sealed mercury amount so as to contribute to the environmental protection.

To achieve the above object, a method for manufacturing a fluorescent bulb according to the present invention comprises the steps of: preparing a glass tube coated on an inner wall surface thereof with a layer of fluorescent material; plugging opposite ends of the glass tube with stems each supporting an electrode; evacuating the glass tube through an exhaust tube provided in at least one of the stems; supplying alloy containing mercury and noble gas into the glass tube through the exhaust tube of the other stem; closing the exhaust tube of the other stem; placing the alloy in an end portion of the glass tube; and applying radiation beam energy to a contact portion between the alloy and the end portion of the glass tube and to the vicinity of the contact portion so as to fix the alloy to the inner wall surface of the glass tube.

According to the method of the invention, thermal energy is supplied directly to the alloy drop by radiation without being transferred through the glass tube. Therefore the adhesion of the alloy drop can be made well regardless of the uneveness of the inner wall surface of the glass tube. Further, by optimizing the dimension and intensity of the beam of radiation energy, the alloy drop can be heated independently of the position thereof and the temperature of the alloy drop can be raised higher than the temperature of the glass tube in a short time, and therefore in cases where the zinc-mercury alloy drop is used, it is possible to prevent the tube wall from being stained due to the evaporation of zinc.

DESCRIPTION OF THE PREFERRED EMBODIMENTS

(Embodiment 1)

Figure 1:
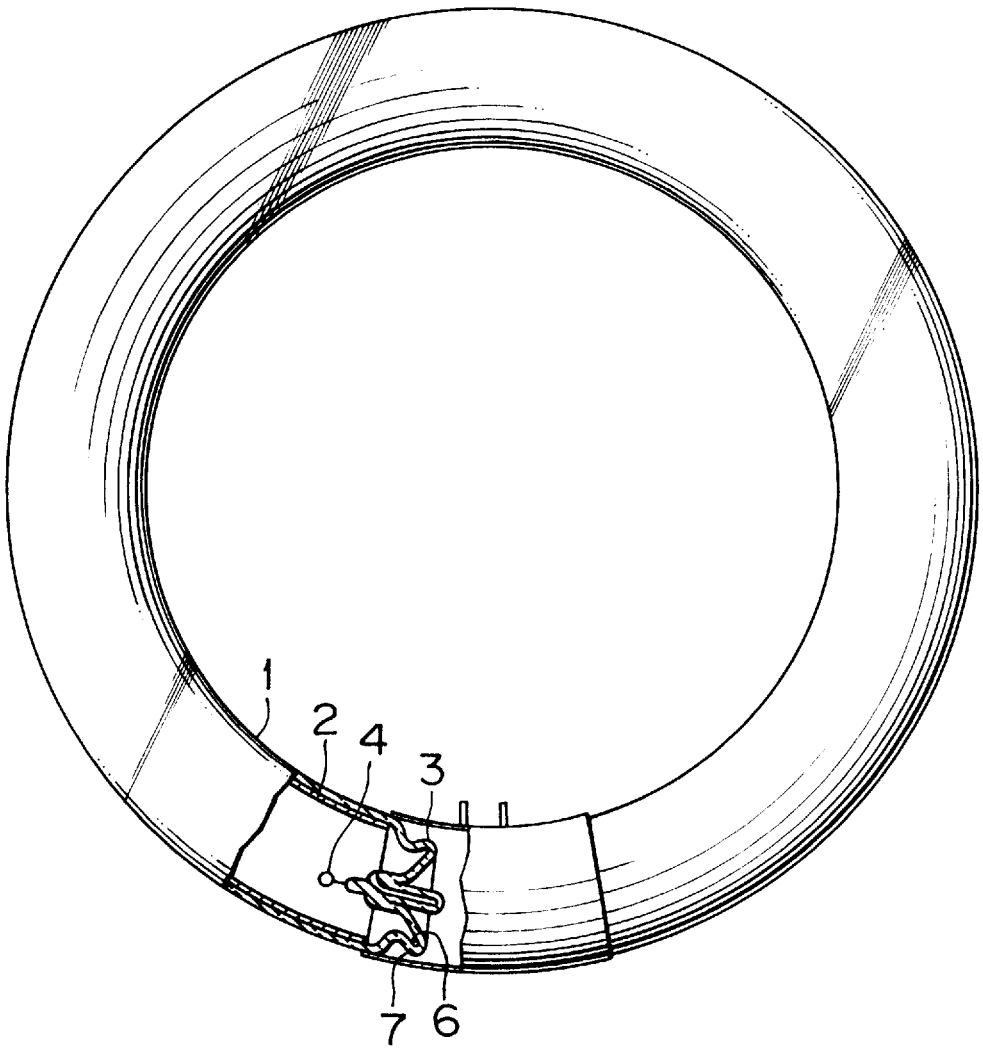
FIG. 1 is a partially broken away front view of a circular fluorescent bulb according to the present invention.

A circular fluorescent lamp or bulb shown in FIG. 1 comprises a glass tube 1 coated on an inner wall surface thereof with a layer 2 of fluorescent material, and glass stems 3 plugging opposite ends of the glass tube 1 and each provided with an electrode 4. The plugged glass tube 1 is filled with rare or noble gas and a drop 6 of alloy containing mercury is disposed in the tube 1. The alloy 6 is a zinc-mercury alloy. It is fixed to the inner wall surface of an end portion 7 of the glass tube 1.

Now, description will be given of a method for manufacturing a circular fluorescent bulb according to the present invention.

A straight glass tube (not shown), which is coated on an inner wall surface thereof with a layer of fluorescent material 2, is plugged at opposite ends thereof with glass stems 3 each provided with an electrode 4. The straight glass tube is bent or curved into a circle while being heated. In case that each of the glass stems includes an exhaust tube, after closing an exhaust tube of one of the glass stems 3, the straight glass tube is bent into a circle one. Then, after evacuating the glass tube through an exhaust tube 8 of the other glass stem 3, an alloy drop 6 and argon gas of a predetermined pressure are inserted into the glass tube through the exhaust tube 8. Thereafter, the exhaust tube 8 is closed. The alloy drop 6 is a substantially spherical one of diameter about 1.5 mm made of a zinc-mercury alloy containing zinc and mercury in the ratio 1:1 by weight. The circular fluorescent bulb in the rated power 30 W class requires 7 mg of mercury. In order to ensure this amount of mercury by a drop of alloy containing mercury and zinc in the ratio 1:1 by weight, the alloy drop should be a solid spherical one of diameter about 1.5 mm at room temperature. It is therefore very easy to handle the alloy drop.

Figure 3:
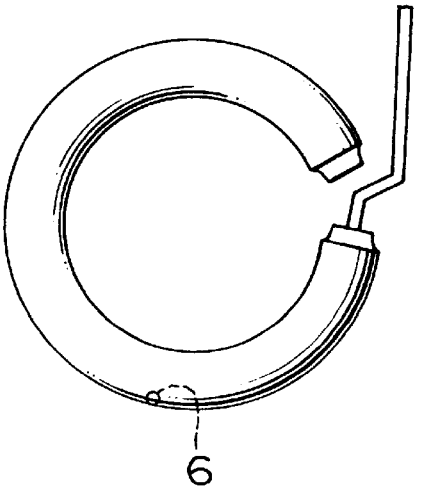
FIG. 3 is a drawing showing a state of the bulb having undergone an evacuating step.
Figure 4:
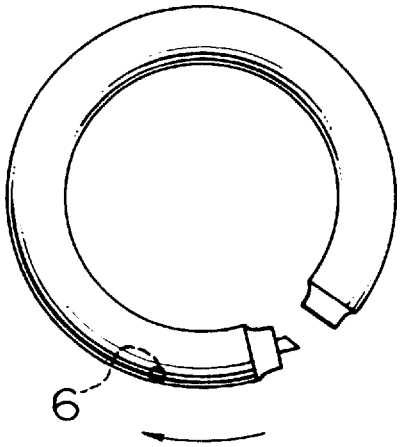
FIG. 4 is a drawing showing a state in which the bulb is rotated in the circumferential direction.
Figure 5:
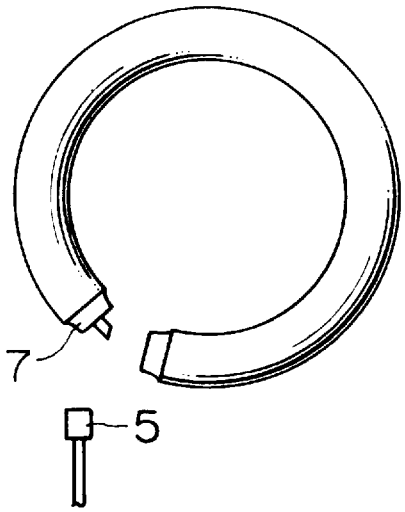
FIG. 5 is a drawing showing a state in which an alloy drop is moved to an end portion of the bulb.
Figure 6:
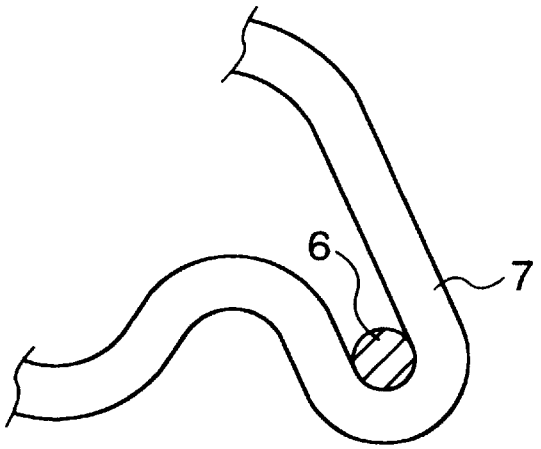
FIG. 6 is a drawing showing a state in which the alloy drop is fixed to an end portion of the glass tube.

As soon as the evacuating is completed, the alloy drop 6 is placed in the end portion 7 of the circular glass tube. FIGS. 3–5 show the manner of moving the alloy drop 6 to the end portion 7. The bulb is held upright (FIG. 3) after the evacuating is completed, it is moved in the circumferential direction (FIG. 4) after closing the exhaust tube 8 until the end portion 7 is so positioned as to be vertically downmost (FIG. 5), thereby making it possible to easily place the alloy drop 6 to the end portion 7 (FIG. 6).

Figure 2:
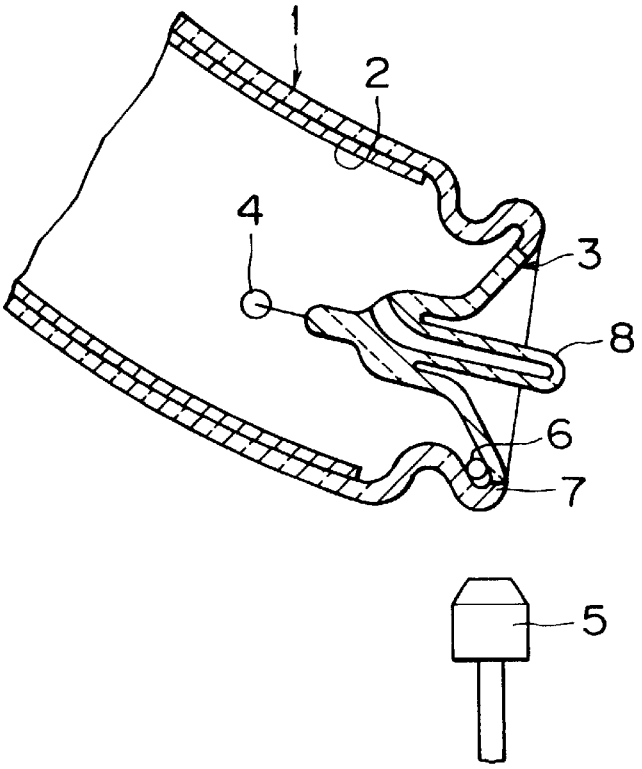
FIG. 2 is a drawing for explanation of a manner of applying radiation beam energy to an end portion of a glass tube.
Figure 7:
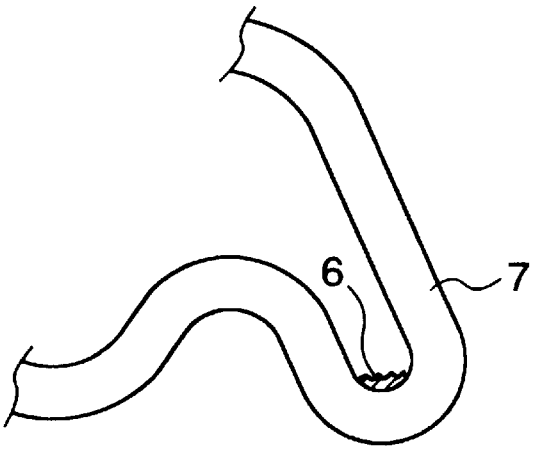
FIG. 7 is a drawing showing a state in which the alloy drop is fixed to the end portion of the glass tube in a deformed condition.

In this state, as shown in FIG. 2, radiation beam energy of about 20 W is applied, after passing through a condensing lens (not shown) to become a beam of diameter about 14 mm, to the end portion 7 of the glass tube for about 2.5 seconds from an optical fiber 5 disposed at a distance of about 39 mm from the end portion 7. The radiation beam energy causes the alloy drop 6 to partly melt at its bottom portion in contact with the glass tube 1, which alloy spreads on and enters into the asperities of the inner wall surface of the glass tube 1 and then solidifies to thereby firmly fix the glass tube 1 and the alloy drop 6 to each other (FIG. 7). Incidentally, a xenon lamp is used for the source of radiation beam energy in this case.

Immediately after the finish of the evacuating step, the temperature of the end portion 7 of the glass tube is kept at about 300° C. In this way, by keeping the end portion 7 of the glass tube at high temperature when applying the radiation beam energy, it is possible to reduce the radiation beam energy required to raise the temperature of the glass tube. Therefore, it becomes possible to make sure of the improvement of production efficiency and the stable production attributed to the reduced intensity or the shortened irradiation time of the radiation beam energy. Further, by controlling the temperature as described above, it becomes possible to manufacture the circular fluorescent bulbs under constant conditions throughout the year regardless of the change in temperature.

The following drop test was conducted on the thus-produced circular fluorescent bulb to examine the state of adhesion of the alloy drop 6. Test results are shown in Table 1. Packages of ten cases, each case consisting of twenty bulbs wrapped separately, were dropped from a height of 25 cm and from a height of 55 cm, respectively. They were examined about the separation of the alloy drop. As apparent from Table 1, all the bulbs manufactured according to the present invention could maintain the state of good adhesion without causing any separation of the alloy drop. To compare with the present invention, the state of adhesion of the alloy drop was examined on the fluorescent bulb of the prior art in which the alloy drop is heated indirectly from the outside of the glass tube by making use of hot blast so as to be fixed to the glass tube. As a result, even when dropping from the height of 25 cm, the adhesion of the alloy drop could not be maintained in some bulbs, and when dropping from the height of 55 cm, all the bulbs suffered the separation of the alloy drop from the inner wall of the glass tube.

[TABLE 1]

| | Present Invention (radiation beam) | Prior Art (hot blast) |
|---|---|---|
| Drop Test from a height of 25 cm | No alloy drops have separated | Alloy drops have separated in some bulbs |
| Drop Test from a height of 55 cm | No alloy drops have separated | Alloy drops have separated in all bulbs |

As described above, according to the method for manufacturing the fluorescent bulb of the present invention, it is possible to easily form the adhesion portion in the contact portion between the glass tube 1 and the alloy drop 6 while preventing any variation from arising. It is therefore possible to prevent the alloy drop 6 from separating from the inner wall surface of the glass tube 1.

In the present embodiment, the temperature of the end portion 7 of the glass tube is about 300° C. when applying the radiation beam energy. In cases where the temperature of the end portion 7 is higher than 300° C., the radiation beam energy may be reduced in intensity or irradiation time, while in cases where this temperature is lower than 300° C., the radiation beam energy may be increased in intensity or irradiation time. However, in cases where the temperature of the end portion 7 is higher than approx. 400° C. which corresponds to the boiling point of mercury, mercury vapor may spout from the zinc-mercury alloy drop 6 before applying the radiation beam energy so as to cause the alloy drop 6 to fail to adhere to the end portion 7. To the contrary, in cases where the temperature of the end portion 7 is lower than 200° C., the radiation beam energy has to be too intensive or the irradiation time has to be too long, which cannot be practicable. Accordingly, it is advisable that the temperature of the glass tube and particularly of the end portion 7 is set to be in the range of 200°–400° C. when applying the radiation beam energy. Further, in this embodiment, although the diameter of the radiation beam is 14 mm, it can be appropriately changed so as to be able to cover the positional dispersion of the alloy drop. In such a case the value of the radiation beam energy may be varied according to the changed beam diameter.

As described above, the manufacturing method according to the present invention is suitable particularly for the manufacture of circular fluorescent bulbs and capable of overcoming the problems of the conventional construction. Namely, it is possible to solve the problem of the prior art that since the capsule encapsulating mercury therein is beforehand mounted in the straight fluorescent bulb in the vicinity of one of the electrodes in advance of shaping, when bending straight the fluorescent bulb, e. g., when shaping the fluorescent bulb into a circular fluorescent bulb, the interior of the fluorescent bulb becomes a high temperature atmosphere to cause the capsule to be broken due to this high heat to thereby release mercury which is to be exhausted in the succeeding evacuating step. Further, by circumferentially moving the circular glass tube in such a manner that the end portion is positioned vertically downmost, the alloy can be smoothly moved to the end portion, and therefore it is possible to efficiently manufacture the circular fluorescent bulbs. However, it is basically possible to obtain the same effects in the cases of the fluorescent bulbs in the form of a straight pipe and in other forms as well.

The number of the alloy drops 6 and the content of mercury, outside diameter, and the like of the alloy drop 6 can suitably be selected according to the type of bulb such as the rated power.

In this embodiment, the light-beam energy of the xenon lamp is used for the radiation beam energy, but any source may be used in so far as it is capable of heating the alloy drop. For example, it is possible to obtain the same effects even by making use of a ultraviolet rays radiator such as a high-pressure discharge lamp, a visible rays radiator such as an incandescent lamp, an infrared rays radiator such as an infrared lamp, or a monochromatic radiator such as a laser, which can all serve as heat source.

(Embodiment 2)

According to the above manufacturing method, the alloy drop 6 melts at a portion thereof in contact with the glass tube end portion 7 so as to be fixed to the inside wall surface of the glass tube end portion 7 as shown in FIG. 6. In this case, the alloy drop 6 is fixed to the inner wall surface of the glass tube end portion 7 without fail, provided that the alloy drops 6 are uniform and the relative positional relation between the alloy drop 6 and the radiation beam is fixed.

However, since the glass tubes differ subtly from each other in the shape and thickness of the glass tube end portion 7, the radiation beam energy may not be applied correctly to the alloy drop owing to the lens effect. Further, attributed to the variation in shape of the alloy drop 6, the dispersion in the relative positional relation between the alloy drop 6 and the radiation beam and the like, the alloy drop 6 is not allowed to constantly adhere under certain conditions. These problems can be avoided by hand-operated fine adjustment in the experiment and the trial manufacture, but such fine adjustment is difficult in a mass production plant. Therefore, in the mass production, there is caused a variation in adhesion strength of the alloy drop 6, with the result that it is hard to prevent every alloy drop 6 from separating from the glass tube. On the other hand, in cases where the radiation beam energy is increased in intensity or irradiation time for the purpose of the reliable adhesion, for example heating at a temperature around the melting point of zinc (about 420° C.) for dozens of seconds, zinc evaporates to adhere to the inner wall surface of the glass tube to stain the glass tube, or mercury evaporates vigorously to let the alloy drop loose from the glass tube end portion 7 for free movement.

To cope with this, the manufacturing method of this embodiment aims to eliminate the above problems by deforming or dispersing the alloy drop 6 irrespective of the variations in the position thereof so as to fix the alloy drop 6 more firmly to the inner wall surface of the glass tube end portion 7.

Figure 8:
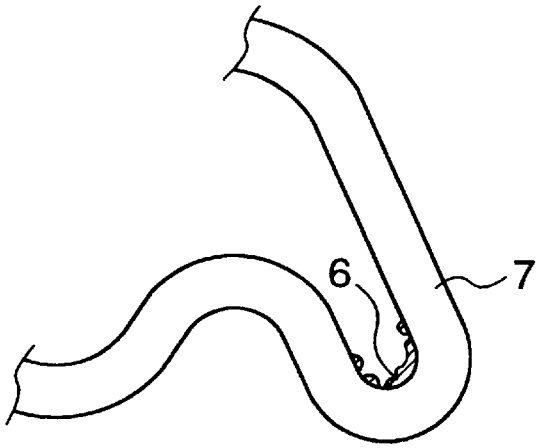
FIG. 8 is a drawing similar to FIG. 7 but showing a state in which the alloy drop is fixed in a dispersed condition.

FIGS. 7 and 8 show the states in which the alloy drop 6 is fixed to the inner wall surface of the concave portion of the glass tube end portion 7 in a deformed condition and in a dispersed condition, respectively. The "deformed condition" means a state in which the alloy drop 6 partly or wholly melted to be seemed as if it was squashed as shown in FIG. 7. However, even if the alloy drop 6 is not brought to the state in which it is flat squashed as shown in FIG. 7, e.g. the alloy drop 6 remains in the form of a semispherical dome with about half thereof melted, the alloy drop 6 can solidify after spreading on and entering into asperities in the inner wall surface of the glass tube end portion 7, and therefore it is possible to assure a sufficiently strong adhesion. Meanwhile, the "dispersed condition" means a state in which the alloy drop 6 was dispersed in the form of granules to retain nothing of its original shape as shown in FIG. 8. By the adhesion in the deformed or dispersed condition as described above, the contact area with the glass tube end portion 7 is made larger than that in the state of adhesion shown in FIG. 6, resulting in a remarkably strong adhesion. Further, since such deformed or dispersed condition can be visually recognized from the outside, it is possible to easily confirm whether the alloy drop 6 is fixed or not.

Now, description will be given of an embodiment in which a circular fluorescent bulb of the rated power 28 W type is manufactured by the fluorescent bulb manufacturing method according to the present invention. Incidentally, specifications of various parts of this fluorescent bulb including the dimensions of the glass tube end portion 7 are the same as those of a conventional 28 W fluorescent bulb so far as there is nothing particular to point.

Up to the radiation beam energy applying step shown in FIG. 2, the fluorescent bulb is manufactured in the same manner as the above embodiment. Namely, a straight glass tube, which is coated on the inner wall surface with a layer of fluorescent material 2, is plugged at opposite ends with glass stems 3 each provided with an electrode 4. After an exhaust tube of one of the glass stems 3 is closed by fusing, the glass tube is bent into a circle while being heated. Then, after evacuating the glass tube through an exhaust tube 8 of the other glass stem 3, an alloy drop 6 and argon gas of a predetermined pressure are inserted into the glass tube 1 through the exhaust tube 8. Thereafter, the exhaust tube 8 is closed by fusing.

The alloy drop 6 is a substantially spherical one of diameter about 1.5 mm, which contains zinc and mercury in the ratio 1:1 by weight and weighs about 14 mg. Meanwhile, the temperature of the glass tube 1 and the glass tube end portion 7 is kept at about 300° C. immediately after the evacuating step is finished.

Subsequently, as shown in FIGS. 3–5, the fluorescent bulb is circumferentially moved until the glass tube end portion 7 is so positioned as to be vertically downmost, thereby causing the alloy drop 6 to move to the glass tube end portion 7. In this state, radiation beam energy is applied through a condensing lens to the glass tube end portion 7 from an optical fiber 5 disposed at a distance of about 45 mm from the glass tube end portion 7. A xenon lamp is used for the light source of this radiation beam energy, the output of which is about 28 W, the beam diameter is about 8 mm on the irradiation area in the glass tube end portion 7, and the irradiation time is about four seconds.

In cases where the radiation beam energy is applied to the alloy drop 6 under such irradiation conditions, if the alloy drop 6 is placed in the spot where it receives the strongest energy, the alloy drop 6 is rapidly heated to be sublimed, with the result that the alloy drop 6 is partly or wholly dispersed to be brought to the state shown in FIG. 8. The remaining part of the alloy drop 6 that was left non-dispersed is caused to melt, spreads on and enters into the asperities in the inner wall surface of the glass tube end portion 7 and then solidifies, and therefore the glass tube end portion 7 and the alloy drop 6 are firmly fixed to each other.

As the alloy drop 6 becomes apart from the spot where it receives the strongest radiation beam energy, the distance from the condensing lens becomes longer, and hence the radiation beam energy which the alloy drop 6 receives is made smaller. Under the irradiation conditions described above, even if the alloy drop 6 is placed in a spot where it receives the radiation beam energy less than anywhere else, since it is possible to apply the radiation beam energy sufficiently enough to partly melt the alloy drop 6, the alloy drop 6 can be deformed as shown in FIG. 7. Namely, so far as the alloy drop 6 is positioned within the irradiation area of the radiation beam, the alloy drop 6 is caused to at least melt and deform regardless of the variation in position of the alloy drop 6, and therefore the alloy drop 6 can be fixed to the inner wall surface of the glass tube end portion 7 with reliability.

In the spot where the alloy drop 6 receives the strongest radiation beam energy, if the energy is too strong, zinc contained in the alloy drop 6 is sublimed to be deposited on the fluorescent material layer 2, resulting in the reduced illuminance of the fluorescent bulb. On the other hand, in the spot where the alloy drop 6 receives the weakest radiation beam energy, if the energy is too weak, the alloy drop 6 cannot melt sufficiently, resulting in the weak adhesion to the inner wall surface of the glass tube. The above-described irradiation conditions are give as an example of the optimums found by the present inventors after repeated trial and error, these conditions depending on various requirements such as the composition, size and shape of the alloy drop 6, the configuration and thickness of the glass stem, the light source and optical system for the radiation beam and the like.

Drop test was conducted on the thus-manufactured circular fluorescent bulb of this embodiment to examine the state of adhesion of the alloy drop. Packages of ten cases, each case consisting of twenty bulbs wrapped separately, were dropped from a height of 55 cm. As a result, all the bulbs could maintain the state of good adhesion without causing any separation of the alloy drop.

Further, since it is possible to visually recognize the alloy drop in the dispersed or deformed condition from the outside, it is possible to easily confirm the fact that the alloy drop is fixed firmly to the inner wall surface of the glass tube.

As has been described above, according to the fluorescent bulb manufacturing method of the present invention, the adhesion of the alloy drop to the glass tube can be performed without causing manufacturing variations, and the separation of the alloy drop from the glass tube can be prevented satisfactorily, and therefore there is caused no separation of the alloy drop, with the result that the alloy drop will never move within the glass tube to damage the coating of fluorescent material, never cast a black shadow to mar the appearance of the bulb or never make a noise. Furthermore, the amount of sealed mercury and the variation in this amount can be made smaller.

What is claimed is:

1. A method for manufacturing a fluorescent bulb comprising the steps of:

preparing a glass tube coated on an inner wall surface thereof with a layer of fluorescent material;

plugging opposite ends of said glass tube with stems each provided with an electrode and an exhaust tube;

closing the exhaust tube of one of said stems;

evacuating said glass tube through the exhaust tube of the other stem;

supplying noble gas and alloy containing mercury into said glass tube through the exhaust tube of said the other stem;

closing the exhaust tube of said the other stem;

placing said alloy in an end portion of said glass tube; and applying radiation beam energy to a contact portion between said alloy and said end portion of said glass tube and the vicinity of said contact portion so as to fix said alloy to the inner wall surface of said glass tube.

2. A method according to claim 1, further comprising the step of:

bending said glass tube into a circle after plugging opposite ends of said glass tube, and wherein said placing step is conducted by moving said circular glass tube circumferentially so that said end portion is so positioned as to be vertically downmost.

3. A method according to claim 2, further comprising the step of:

heating said end portion of said glass tube up to a predetermined temperature in advance of applying the radiation beam energy.

4. A method according to claim 3, wherein said alloy is an alloy of zinc and mercury.

5. A method according to claim 4, said predetermined temperature is between 200° C. and 400° C.

6. A method according to claim 2, wherein said alloy is an alloy of zinc and mercury.

7. A method according to claim 6, further comprising the step of:

heating said end portion of said glass tube between 200° C. and 400° C. in advance of applying said radiation beam energy.

8. A method according to claim 1, further comprising the step of:

heating said end portion of said glass tube up to a predetermined temperature in advance of applying the radiation beam energy.

9. A method according to claim 4, wherein said alloy is an alloy of zinc and mercury.

10. A method according to claim 9, said predetermined temperature is between 200° C. and 400° C.

11. A method according to claim 1, wherein said alloy is an alloy of zinc and mercury.

12. A method according to claim 11, further comprising the step of:

heating said end portion of said glass tube between 200° C. and 400° C. in advance of applying said radiation beam energy.

13. A method for manufacturing a fluorescent bulb comprising the steps of:

preparing a glass tube coated on an inner wall surface thereof with a layer of fluorescent material;

plugging opposite ends of said glass tube with stems each supporting an electrode;

evacuating said glass tube through an exhaust tube provided in at least one of said stems;

supplying noble gas and alloy containing mercury into said glass tube through the exhaust tube of said the other stem;

closing the exhaust tube of said the other stem;

placing said alloy in an end portion of said glass tube; and applying radiation beam energy to a contact portion between said alloy and said end portion of said glass tube and the vicinity of said contact portion so as to fix said alloy to the inner wall surface of said glass tube.

* * * * *